United States Patent [19]

Jeavons et al.

[11] 4,139,998

[45] Feb. 20, 1979

[54] LOCK UNITS

[75] Inventors: Philip S. Jeavons, Birmingham; Wilfrid D. Rogers, Solihull, both of England

[73] Assignee: Wilmot-Breeden Limited, Birmingham, England

[21] Appl. No.: 880,872

[22] Filed: Feb. 23, 1978

[30] Foreign Application Priority Data

Feb. 23, 1977 [GB] United Kingdom ..... 7636/77

[51] Int. Cl.[2] ..... E05B 9/08

[52] U.S. Cl. ..... 70/370

[58] Field of Search ..... 70/370, 451, 448, 449; 248/27.1, 27.3

[56] References Cited

U.S. PATENT DOCUMENTS

| | | | |
|---|---|---|---|
| 2,745,275 | 5/1956 | Jacobi | 70/370 |
| 3,190,092 | 6/1965 | Patriquin | 70/370 |
| 3,604,230 | 9/1971 | Tixier | 70/181 |

*Primary Examiner*—Robert L. Wolfe

*Attorney, Agent, or Firm*—Young & Thompson

[57] ABSTRACT

A lock unit or assembly for mounting on an aperture in a panel of a motor vehicle consists of a housing and a retaining sleeve which are held against relative rotation. The housing and sleeve are fitted together into the aperture and are then rotated to bring a projecting lug on the sleeve into a retaining position whereupon relative axial movement is effected between the housing and sleeve to effect resilient interengagement between cooperating formations on the housing and sleeve to hold the sleeve and housing against movement relative to each other or to the panel.

10 Claims, 7 Drawing Figures

LOCK UNITS

FIELD OF THE INVENTION

This invention relates to lock assemblies and is particularly concerned with the mounting of a private lock assembly in a motor vehicle.

BACKGROUND OF THE INVENTION

One method at present in use for the mounting of a lock assembly in an aperture in a panel in a motor vehicle includes providing a flange on the lock housing, fitting the housing in the aperture from one side of the panel so that the flange bears against the surround of the aperture, and engaging a spring clip or other fastener with the body of the housing so as to bear against the other side of the panel. Since this method involves operations effected from both sides of the panel, i.e. fitting of the assembly from one side and engagement of the spring clip from the other side, it cannot be effected as efficiently as would be the case if the whole assembly operation could be effected from one side of the panel. It is thus an object of the invention to provide an improved form of lock assembly the design of which is such as to enable the necessary operations for insertion of the assembly in an aperture in a panel to be carried out from one side only of the panel.

SUMMARY OF THE INVENTION

A lock assembly includes a housing and a retaining sleeve which fits around the housing, the housing and sleeve being intended to be fitted together into an aperture of a panel, which aperture is of generally circular form but includes at least one cut-out, the housing and sleeve being held against relative rotation but being movable relatively axially from an initial position to an assembled position in which resiliently interengageable formations on the housing and sleeve co-operate to prevent return relative axial movement, the housing and sleeve each including a generally cylindrical body which will pass through the aperture in the panel and a flange which will not pass through the aperture, the sleeve also including at least one projecting lug which, when aligned with the associated cut-out, can be passed through the cut-out whereupon, upon rotation of the sleeve and housing relative to the panel, the lug is moved into a position in which it acts to prevent axial displacement of the sleeve relative to the panel, and the housing also including a projecting lug for engagement with the or a cut-out to prevent rotation of the housing relative to the panel.

In fitting the lock assembly in the aperture, the sleeve and the housing (in their original relative axial positions) are positioned angularly so that the projecting lug on the sleeve is aligned with the cut-out and the bodies of the sleeve and the housing are then entered into the aperture until the flange on the sleeve abuts the surround of the aperture. The sleeve and housing are then turned relative to the panel into a position in which the projecting lug on the housing is aligned with the cut-out, whereupon the housing is displaced axially relative to the sleeve and to the panel to cause the projecting lug on the housing to enter the cut-out and to effect engagement between the resiliently interengageable formations of the sleeve and housing such that the sleeve and housing are held against axial or rotational movement relative to each other or relative to the panel.

DESCRIPTION OF THE PREFERRED EMBODIMENT

Figure 1:
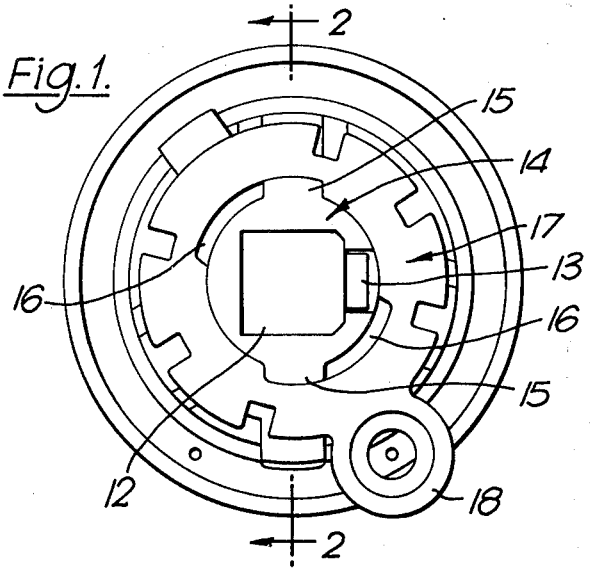
FIG. 1 is an end view of a private lock assembly.

The assembly shown in the drawings includes a housing 10 within which a locking device 11 is fitted, the device being constructed as described in U.S. Patent Specification No. 3,988,912 to which reference should be made. The device 11 has a square cross-section output shaft 12 with a projecting tag 13 whereby the shaft 12 can have a snap-fit connection with a plastics drive plate 14 formed with a corresponding square cross-section bore to receive the shaft 12. The drive plate 14 has diametrically opposed drive lugs 15 which engage within rebates 16 in an operating lever 17 so that, upon insertion of the key and rotation of the device 11 relative to the housing 10, drive is transmitted to the operating lever 17 which is connected by a linkage to, for example, a locking lever of a door latch, the linkage (not shown) being connected to an apertured lug 18 of the operating lever 17.

Figure 3:
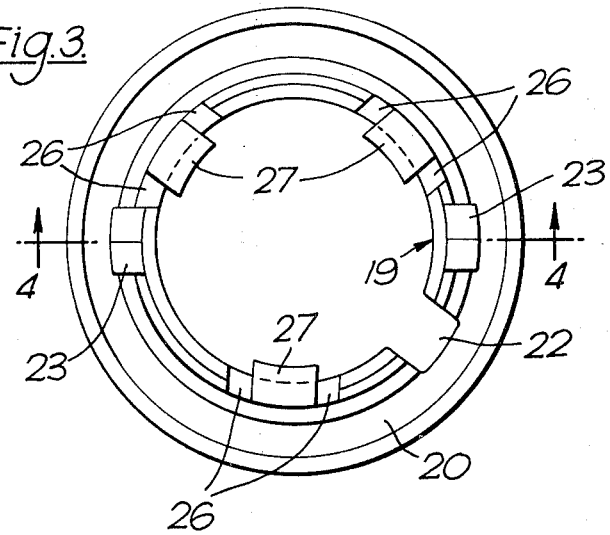
FIG. 3 is an end view of a retaining sleeve forming part of the lock assembly of FIGS. 1 and 2.
Figure 4:
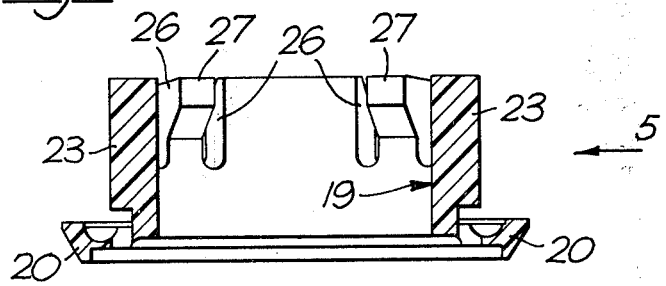
FIG. 4 is a sectional view of the retaining sleeve along the line 4 — 4 of FIG. 3.
Figure 7:
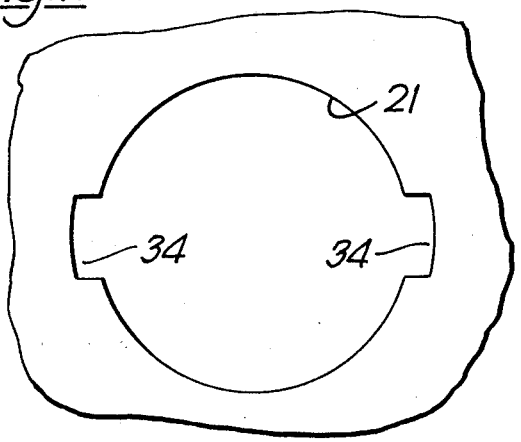
FIG. 7 shows the configuration of an aperture in which the assembly can be fitted.

As can be seen from FIGS. 3 and 4, the retaining sleeve 19, which fits over the housing 10, is of generally cylindrical form and is flanged at one end. The flange is in the form of a projecting skirt 20 which is so shaped that, when the cylindrical body of the sleeve 19 is fitted through an aperture in a panel, such as the aperture 21 shown in FIG. 7, and the skirt 20 is pressed against the panel, the radially outermost portion of the skirt 20 has positive sealing engagement with the panel thereby avoiding any requirement for a separate sealing member. A longitudinal slot 22 formed in the cylindrical wall of the sleeve body extends for the length of the sleeve 19 and registers with a rebate in the skirt 20, the longitudinal slot 22 being disposed adjacent one of two projecting lugs 23 shown in detail in FIG. 5.

Figure 5:
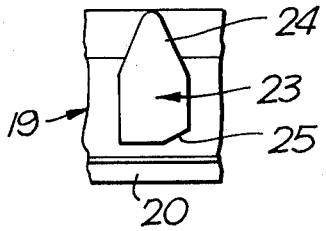
FIG. 5 is a scrap view of the retaining sleeve in the direction of the arrow 5 in FIG. 4.
Figure 6:
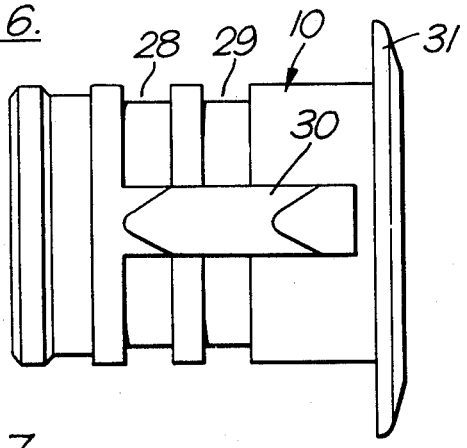
FIG. 6 is a side view of a housing forming part of the lock assembly of FIGS. 1 and 2.

Each lug 23 has, as shown in FIG. 5, a tapered nose portion 24 at the end thereof remote from the skirt 20, the nose portions 24 of the two diametrically opposed lugs 23 providing a lead-in to facilitate insertion of the lock assembly in the aperture 21 in the panel. The lugs 23 are arranged to pass through radially extending cut-outs 34 of the aperture 21, the lugs 23 having chamfered surfaces 25 facing towards the skirt 20 with the spacing between the lugs 23 and the skirt 20 so related to the thickness of the panel that, when the lugs 23 have been passed through the cut-outs 34 and the sleeve 19 is then rotated, engagement of the chamfered surfaces 25 with the side walls of the cut-outs 34 provides a biassing action serving to draw the skirt 20 towards the outer surface of the panel and to effect resilient deformation of the skirt 20. This action ensures that the positive sealing engagement referred to above is obtained.

Figure 2:
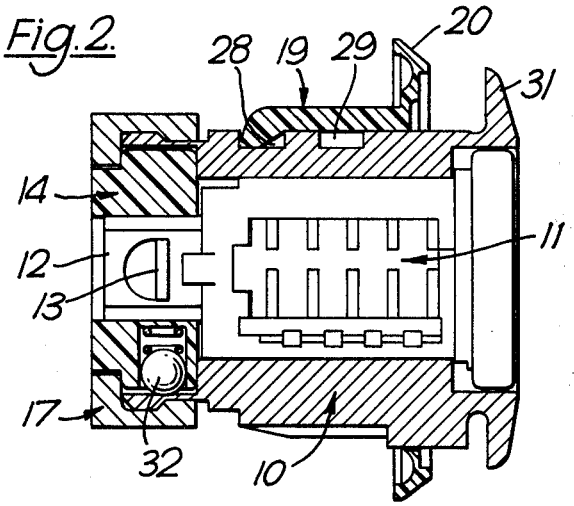
FIG. 2 is a sectional view of the lock assembly along the line 2 — 2 of FIG. 1.

In addition to the longitudinal slot 22, the generally cylindrical body of the sleeve 19 is formed with six longitudinally extending slits 26 which extend for part of the length of the sleeve 19 and are arranged in pairs so as to define three angularly spaced tongues 27. At their ends remote from the skirt 20, the tongues 27 are enlarged to provide locating formations which are initially arranged to enter a first peripheral groove 28 in the housing 10. The arrangement is that, with the sleeve 19 and housing 10 in their initial relative axial positions as shown in FIG. 2, the sleeve 19 and housing 10 are fitted together into the aperture 21 and are then rotated, after which the housing 10 is pressed axially relative to the sleeve 19 so that the tongues 27 are displaced resiliently outwardly until the locating formations are aligned with a second peripheral groove 29 in the housing 10 whereupon the tongues 27 move resiliently inwardly to provide a snap-fit interengagement between the sleeve 19 and the housing 10 which is such as to prevent subsequent separation of the sleeve 19 and housing 10.

A single projecting spigot 30 is provided on the housing 10, the spigot 30 being arranged to pass into one of the cut-outs 34 after the lugs 23 have been passed through the cut-outs 34 and the sleeve 19 and housing 10 have been turned through the appropriate angle which, in the embodiment illustrated, is 36°. The spigot 30 registers with, and is received within, the longitudinal slot 22 in the sleeve 19 so that relative rotational movement between the sleeve 19 and the housing 10 is prevented. A flange 31 is provided at the outer end of the cylindrical body of the housing 10, the spigot 30 terminating short of the flange 31 but the space between the flange 31 and the spigot 30 being less than the thickness of the skirt 20 on the sleeve 19. The spigot 30 can thus pass into but not completely through the cut-out 34 so that, once the spigot 30 has been entered into the associated cut-out, by axial movement of the housing 10, the housing 10 and thus also the sleeve 19 is prevented from rotating relative to the panel.

Although the housing 10 and sleeve 19 can be fitted in the aperture in the panel prior to installation of the locking device 11 in the housing 10, the locking device 11 and its associated drive mechanism are preferably assembled with the housing 10 prior to installation thereof in the panel, the components being supplied to the vehicle manufacturer as a sub-assembly with, for example, a cardboard collar or sleeve temporarily disposed between the skirt 20 on the sleeve and the flange 31 on the housing 10 to prevent inadvertent relative axial movement between the sleeve 19 and housing 10. As shown, the drive mechanism comprises the drive plate 14 and the operating lever 17, indexing being obtained by means of a spring-loaded ball 32 disposed within a bore in the drive plate 14.

No clips or screws are required for attachment of the lock assembly to the panel, the sleeve 19 preferably being formed from an acetal resin and the housing 10 being formed from either an acetal resin or a zinc-based alloy.

What is claimed is:

1. A lock assembly which includes a housing and a retaining sleeve which fits around the housing, the housing and sleeve being intended to be fitted together into an aperture of a panel, which aperture is of generally circular form but includes at least one cut-out, the housing and sleeve being held against relative rotation but being movable relatively axially from an initial position to an assembled position in which resiliently interengageable formations on the housing and sleeve cooperate to prevent return relative axial movement, the housing and sleeve each including a generally cylindrical body which will pass through the aperture in the panel and a flange which will not pass through the aperture, the sleeve also including at least one projecting lug which, when aligned with the associated cut-out, can be passed through the cut-out whereupon, upon rotation of the sleeve and housing relative to the panel, the lug is moved into a position in which it acts to prevent axial displacement of the sleeve relative to the panel, and the housing also including a projecting lug for engagement with the or a cut-out to prevent rotation of the housing relative to the panel.

2. A lock assembly according to claim 1 and for use with a panel the aperture of which has two diametrically opposed cut-outs, wherein the sleeve has two diametrically opposed projecting lugs which are arranged to pass through the cut-outs.

3. A lock assembly according to claim 2, wherein the flange on the sleeve is in the form of a flexible skirt and the lugs have chamfered surfaces facing towards the skirt.

4. A lock assembly according to claim 1, wherein the generally cylindrical body of the sleeve is formed with a plurality of longitudinally extending slits so as to define a plurality of angularly spaced tongues.

5. A lock assembly according to claim 4, wherein the ends of the tongues remote from the sleeve on the skirt are enlarged and enter a peripheral groove in the housing, the tongues and groove constituting the resiliently interengageable formations on the housing and sleeve.

6. A lock assembly according to claim 1, wherein the projecting lug of the housing is received within a channel in the cylindrical body of the sleeve to hold the housing and sleeve against relative rotation.

7. A lock assembly according to claim 1, wherein the housing contains a key-operable locking device having an output shaft which fits within a bore in a drive plate.

8. A lock assembly according to claim 7, wherein the drive plate is arranged to transmit drive to an operating lever which is snap-fitted on to the end of the housing so as to retain the drive plate within the housing.

9. A method of mounting a lock assembly in an aperture in a panel, which includes:

a. providing an aperture which is of generally circular form but includes at least one cut-out, b. providing a lock assembly which consists of a housing and a sleeve each of which includes a generally cylindrical body which will pass through the aperture and a flange which will not pass through the aperture, the housing and sleeve each having a projecting lug corresponding in cross-section to the cut-out of the aperture, c. fitting the sleeve around the housing so that the projecting lug of the housing enters a longitudinal channel in the cylindrical body of the sleeve, d. fitting the cylindrical bodies of the housing and sleeve into the aperture so as to bring the flange on the sleeve into engagement with the surround of the aperture and to move the projecting lug on the sleeve through the cut-out of the aperture, e. rotating the housing and sleeve relative to the panel to bring the projecting lug on the housing into register with the cut-out and bring the projecting lug on the sleeve into engagement with the rear of the panel and f. displacing the housing axially relative to the sleeve to cause the projecting lug on the housing to enter the cut-out thereby preventing rotation of the housing and sleeve relative to the panel, such displacement also bringing the flange on the housing into contact with the flange on the sleeve and effecting resilient interengagement of formations on the housing and sleeve which act to prevent return axial movement of the housing relative to the sleeve.

10. A method according to claim 9, which includes providing two axially spaced circumferential grooves in the housing which cooperate with resilient tongue formations of the sleeve and wherein axial displacement of the housing serves to move the housing from a position in which the tongue formations register with one groove to a position in which the tongue formations register with the other groove.

* * * * *

UNITED STATES PATENT AND TRADEMARK OFFICE

CERTIFICATE OF CORRECTION

PATENT NO. : 4,139,998

DATED : February 20, 1979

INVENTOR(S) : Philip S. Jeavons, et al

It is certified that error appears in the above—identified patent and that said Letters Patent is hereby corrected as shown below:

The title page should be deleted to insert the attached title page therefor.

Signed and Sealed this

*Nineteenth* Day of *February 1980*

[SEAL]

*Attest:*

SIDNEY A. DIAMOND

*Attesting Officer*

*Commissioner of Patents and Trademarks*

United States Patent [19]

Jeavons et al.

[11] 4,139,998

[45] Feb. 20, 1979

[54] LOCK UNITS

[75] Inventors: Philip S. Jeavons, Birmingham; Wilfrid D. Rogers, Solihull, both of England

[73] Assignee: Wilmot-Breeden Limited, Birmingham, England

[21] Appl. No.: 880,872

[22] Filed: Feb. 23, 1978

[30] Foreign Application Priority Data

Feb. 23, 1977 [GB] United Kingdom ..... 7636/77

[51] Int. Cl.[2] ..... E05B 9/08

[52] U.S. Cl. ..... 70/370

[58] Field of Search ..... 70/370, 451, 448, 449; 248/27.1, 27.3

[56] References Cited

U.S. PATENT DOCUMENTS

| | | | |
|---|---|---|---|
| 2,745,275 | 5/1956 | Jacobi | 70/370 |
| 3,190,092 | 6/1965 | Patriquin | 70/370 |
| 3,604,230 | 9/1971 | Tixier | 70/181 |

*Primary Examiner*—Robert L. Wolfe

*Attorney, Agent, or Firm*—Young & Thompson

[57] ABSTRACT

A lock unit or assembly for mounting in an aperture in a panel of a motor vehicle consists of a housing and a retaining sleeve which are held against relative rotation. The housing and sleeve are fitted together into the aperture and are then rotated to bring a projecting lug on the sleeve into a retaining position whereupon relative axial movement is effected between the housing and sleeve to effect resilient interengagement between cooperating formations on the housing and sleeve to hold the sleeve and housing against movement relative to each other or to the panel.

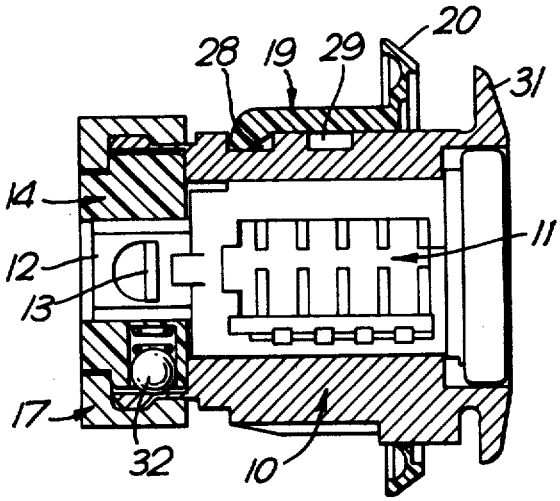

10 Claims, 7 Drawing Figures